US005537703A

United States Patent [19]

Launder et al.

[11] Patent Number: 5,537,703

[45] Date of Patent: Jul. 23, 1996

[54] MULTI-POSITION PILLOW

[75] Inventors: Darla D. Launder, Richmond, Va.; Edward O. Norris, Russellville, Ky.

[73] Assignee: Carpenter Co., Richmond, Va.

[21] Appl. No.: 316,590

[22] Filed: Sep. 30, 1994

[51] Int. Cl.[6] ..... A47C 20/02

[52] U.S. Cl. ..... 5/636; 5/638; 5/901

[58] Field of Search ..... 5/636, 638, 637, 5/481, 901

[56] References Cited

U.S. PATENT DOCUMENTS

| | | | |
|---|---|---|---|
| D. 222,349 | 10/1971 | Sorensen . | |
| D. 238,235 | 12/1975 | Elgebrandt | D6/201 |
| D. 282,037 | 1/1986 | Lawson et al. . | |
| D. 308,311 | 6/1990 | Forsland . | |
| D. 310,610 | 9/1990 | Dixon | D6/601 |
| D. 317,236 | 6/1991 | Dixon | D6/601 |
| 2,199,479 | 5/1940 | Cappel | 5/338 |
| 2,380,102 | 7/1945 | Farmer . | |
| 3,124,812 | 3/1964 | Milton | 5/636 |
| 3,319,272 | 5/1967 | Eller | 5/636 |
| 3,403,414 | 10/1968 | Unger | 5/636 |
| 3,694,831 | 10/1972 | Treace | 5/338 |
| 3,716,877 | 2/1973 | Glintz | 5/636 |
| 4,132,228 | 1/1979 | Green . | |
| 4,218,792 | 8/1980 | Kogan | 5/636 |
| 4,320,543 | 3/1982 | Dixon | 5/434 |
| 4,686,724 | 8/1987 | Bedford | 5/468 |
| 4,777,855 | 10/1988 | Cohen | 83/862 |
| 4,788,728 | 12/1988 | Lake | 5/434 |
| 4,866,800 | 9/1989 | Bedford | 5/468 |
| 4,908,893 | 3/1990 | Smit | 5/434 |
| 4,972,535 | 11/1990 | Goldman | 5/481 |
| 5,014,377 | 5/1991 | Dixon | 5/434 |
| 5,018,231 | 5/1991 | Wang | 5/636 |
| 5,079,790 | 1/1992 | Pouch | 5/431 |
| 5,153,956 | 10/1992 | Nold | 5/448 |
| 5,163,194 | 11/1992 | Dixon | 5/636 |
| 5,226,188 | 7/1993 | Liou | 5/653 |
| 5,423,099 | 6/1995 | Gulli | 5/638 |

FOREIGN PATENT DOCUMENTS

| | | | |
|---|---|---|---|
| 2609616 | 7/1988 | France | 5/636 |
| 2225229 | 5/1990 | United Kingdom . | |
| WO86/07528 | 12/1986 | WIPO . | |

*Primary Examiner*—Michael J. Milano

*Attorney, Agent, or Firm*—Beveridge, DeGrandi, Weilacher & Young

[57] ABSTRACT

A pillow includes a first main face having an essentially planar main surface. This planar main surface includes a head receiving recess. The second main face of the pillow, located opposite the first main face, includes a plurality of extending fingers arranged in rows, wherein the fingers extend such that a base of the finger is located closer to the first main face than is the tip (or free end) of that finger. The fingers are of a length such that the finger tips essentially lie on a common plane which is essentially parallel to the essentially planar main surface of the first main face. Several recesses are defined in the area between a finger and the surrounding, adjacent fingers of the second main face. In particularly preferred embodiments of the pillow, the recesses between adjacent fingers extend through the pillow so as to provide vent holes through the pillow in the area of the head receiving recess. These vent holes can be formed in a preferred embodiment which involves coordinating the depth of the head receiving recess with respect to the depth of the adjacent valleys so that the innermost end of certain valleys open out into the head receiving recess. The pillow is advantageously made from a polyurethane foam material.

33 Claims, 5 Drawing Sheets

MULTI-POSITION PILLOW

BACKGROUND OF THE INVENTION

Pillow designs and construction have varied dramatically over the years. Many pillows were previously made including feathers or other relatively soft stuffing materials as the cushioning support. In more recent years, synthetic materials have been favored as the material of choice for constructing pillows.

Various pillow designs and materials are available to provide specified levels of support to the user. One such pillow design is disclosed in U.S. Pat. No. 4,320,543 to Dixon. The pillow is described as a medical pillow for providing stabilized support for the head and neck of the user. This support is provided by incorporating a convoluted upper pillow surface to cradle the neck and head of the user. This patent is entirely incorporated herein by reference.

Anti-snore pillows are described and illustrated in U.S. Pat. Nos. 5,014,377, 5,123,132, and D-310,610, all to Dixon. Each of these patents is entirely incorporated herein by reference. An elongated bolster area is provided on the top surface of the pillow to support the neck of the user. The bolster and base member act in conjunction with one another to decrease blockage of the user's breathing passageway when the user sleeps on his back or side. Thus, the pillow acts to decrease the tendency of a person to snore.

Several other pillow designs are available and known in the art. A brief discussion of exemplary embodiments of pillow designs is included below.

U.S. Pat. No. 3,694,831 (Treace) relates to a medical head support pillow for use in hospitals. The head support includes a base portion which rests on a supporting surface and inclined side pads. It is described that this pillow is suitable for use as a positioner for the head while a patient is under anesthesia for surgery. This patent is entirely incorporated herein by reference.

Ashley, U.S. Pat. No. 3,851,347 (which patent is entirely incorporated herein by reference), relates to a pillow construction that includes recesses defined therein. This pillow construction is said to dampen or eliminate the sound of the user's heartbeat while lying on the pillow.

Lake, U.S. Pat. No. 4,788,728, discloses a contoured pillow having a central aperture over which the user's face is positioned during use. It is disclosed that the aperture is located such that pressure against the user's face is reduced, thereby reducing the tendency of the face to wrinkle. Similarly, Smit (U.S. Pat. No. 4,908,893) discloses a pillow including a concave or open area located so as to reduce stress in the facial tissues, thereby reducing wrinkling. Each of these patents also is entirely incorporated herein by reference.

U.S. Pat. No. 4,777,855 to Cohen discloses a composite pillow construction which includes a separate insertable core portion that may be used to provide variable levels of firmness. The Cohen patent is entirely incorporated herein by reference.

Sprague, Jr. (U.S. Pat. No. 4,799,275) discloses a shock absorbing pillow which includes a core material having small openings. This core material is wrapped with a cushion and another covering. This patent is entirely incorporated herein by reference.

SUMMARY OF THE INVENTION

This invention relates to an improved pillow construction wherein a single pillow is capable of providing different levels of support. One surface of the pillow is essentially smooth to provide a relatively firm support, while another surface of the pillow is convoluted to provide relatively soft support. Preferably, the pillow is constructed from a unitary, single piece of polyurethane foam material. Also, it is preferred that this pillow include air ventilation holes to promote air circulation.

The invention relates to a multi-position pillow which includes a first contact surface portion and a second contact surface portion arranged opposite to the first contact surface portion. A peripheral side edge extends between the first and second contact surface portions of the pillow. The first contact surface portion has a head receipt or receiving recess extending inwardly into the pillow in the direction toward the second contact surface portion. Preferably, this head receiving recess is the sole recess in the first contact surface portion. The second contact surface portion includes a plurality of protrusions, preferably finger shaped protrusions, which are separated from one another by valleys. Preferably, this protrusion and valley construction covers the entire exterior contact surface of the pillow's second contact surface portion. In addition, in the pillow in accordance with the invention, the first and second contact surface portions are each dimensioned and arranged such that either contact surface portion can provide head support for the user, while the opposite surface portion contacts an underlying support, such as a mattress.

The head receipt recess in the pillow in accordance with the invention preferably is essentially centrally positioned with respect to the first contact surface portion. The preferred head receipt recess includes a more central depression area and a less central depression area extending off from a peripheral boundary of the more central depression area, wherein the less central depression area opens into the more central depression area. The less central depression area extends toward a side edge of the pillow. In one embodiment, the less central depression area may extend so as to cut away a portion of one side edge of the pillow. Advantageously, the more central depression area is deeper than the less central depression area.

In one particularly preferred embodiment of the invention, the pillow includes a plurality of vent holes which extend through the pillow from the first contact surface portion to the second contact surface portion, wherein the vent hole openings are provided in the more central depression area of the head receipt recess or in both of the depression areas. Preferably, the first contact surface portion of the pillow has an exterior contacting surface that is non-convoluted except for the single head receipt recess positioned inwardly of a horizontally planar surrounding region, which surrounding region represents about 30 to 50%, preferably 35–45%, of the entire surface area of the first contact surface portion of the pillow. Also, the vent holes open out at the exterior of the second contact surface portion of the pillow such that the holes extend completely through the pillow.

The protrusions in the second contact surface portion of the pillow in accordance with the invention are preferably made up of essentially conical or circumferentially tapering finger shaped extensions each having a base portion contacting at least one adjacent extension. The valleys between the protrusions extend below a level of the base portions (i.e., the level where one base portion contacts an adjacent base portion) and are positioned between adjacent extensions. It is preferred that the extensions have a length extending from the base to a tip thereof of about 3–8 cm, with about 5 cm being particularly preferred. It is also preferred that this length corresponds to about 25 to 50% of a total maximum thickness of the pillow between the first contact surface portion and the second contact surface portion, with about 35% being preferred. Preferably, the total maximum thickness is in the range of about 10–20 cm, and preferably about 14 cm. Also, it is preferred that the extensions have a maximum peripheral, cross-sectional area of less than 12 $cm^2$ at their base, and preferably less than 8 $cm^2$. The diameter of a cross-section of the base taken at the aforementioned level where the base of one protrusion contacts the base of another preferably has a ratio of 1:4 to 1:1 with respect to a length of a central vertical axis extending from the cross-section level up to the tip or the top surface (if planar) of the protrusion. This ratio is preferably about 3:5.

In one particularly preferred embodiment, the base is essentially a square having about 2.5 cm side edges (corresponding to a base area of about 6.25 $cm^2$), and the central vertical axis length is about 5 cm.

The first contact surface portion with the head receipt recess formed therein and with a smooth, non-contoured exterior surface is adapted to receive a head of a user. This first contact surface portion with full contact exterior surface provides firm support for the user. The second contact surface portion of the pillow includes a plurality of protrusions extending up away from an intermediate portion of the pillow (i.e., the central area of the pillow positioned between the first and second contact surface portions). This second contact surface portion also is adapted to receive the head of a user and provides a softer support surface than the first contact surface portion.

In a preferred embodiment, vent holes open out at the exterior of the first contact surface portion and extend to the exterior surface of the second contact surface portion. Preferably, the vent holes are provided so as to open into the head receipt recess of the first contact surface portion and into valleys provided between the protrusions of the second contact surface portion. This provides for good air flow when the second contact surface portion is in an underlying surface contact position, because air is free to circulate between the protrusions and through the vent holes so as to ventilate a head in position within the full contact surface of the central depression area. When the second contact surface portion is supporting the head of the user, air is free to circulate between the protrusions, which protrusions are preferably not compressed to the extent that the head blocks off all air circulation. Also, the air pocket provided by the central depression provides both a source of air for circulation and a damping, cushioning effect as air is exhausted upon compression of the pillow. The embodiment with the less central depression area extending to the side edge also provides for increased air circulation. This less central depression area provides good neck support, and thus, the head receipt recess actually forms a head and neck receiving recess in a preferred embodiment.

Expressed in a different manner, the pillow in accordance with the invention includes a first main face having a head receiving recess defined therein. A second main face is provided opposite the first main face and includes a plurality of extending fingers, preferably arranged in rows, wherein the fingers extend such that a base of the finger is located in a direction toward the first main face of the pillow, and a tip of the finger extends away from the first main face. The finger tips of the second main face of the pillow extend an essentially uniform distance so as to define an essentially planar surface. Recesses are defined in the area of the second main face of the pillow between a finger and the surrounding, adjacent fingers.

Preferably, the pillow is made from a polyurethane foam material. The pillow is also preferably formed of a unitary body of common foam material, but the present invention also contemplates a laminated arrangement of various different materials or the same material (e.g., the first and second contact surface portions or first and second main faces may be formed of different foam materials).

In a particularly preferred embodiment of the invention, in a portion of the second main face opposite the head receiving recess of the first main face, holes extend from the recesses between a plurality of adjacent fingers through the pillow material so as to define a plurality of holes extending from the second main face and through the pillow so as to open in a central area of the head receiving recess.

The pillow is preferably rectangular in peripheral shape with a longer longitudinal length than depth. It is particularly preferred that the extending fingers of the second main face are arranged in staggered rows along the longitudinal direction of the pillow, such that the fingers in one longitudinal row are located between two adjacent fingers in a next, adjacent longitudinal row.

The head receiving recess in one preferred embodiment of the invention includes a neck support portion located adjacent one longitudinal edge of the first main face of the pillow and the head supporting portion has a boundary edge located adjacent and extending essentially parallel to an opposite longitudinal edge of the first main face. A central portion of the head receiving recess is located between the neck support portion and the boundary edge extending adjacent the opposite longitudinal edge. Advantageously, the neck support portion is narrower than the central portion of the head receiving recess in the longitudinal direction.

In one preferred embodiment of the pillow in accordance with the invention, the neck support portion of the head receiving recess extends to and opens out at the longitudinal edge of the first main face of the pillow such that the neck support portion is visible along a side face of the pillow that extends between the first main face and the second main face. Alternatively, in another preferred embodiment, the neck support portion of the head receiving recess does not extend to the longitudinal edge of the first main face, but the top portion of the head receiving recess extends essentially all the way to the opposite longitudinal top edge of the pillow. In this embodiment, the neck support portion of the head receiving recess is not visible along a side face of the pillow extending between the first main face and the second main face.

The present invention also provides a unique method of making wherein the depth and cross-sectional diameter of the valleys between adjacent protrusions on the second contact surface portion are coordinated with the depth of the head receiving recess in the first contact surface portion so that the vent holes are automatically formed when the central recess and the valleys are cut out or formed (e.g., molded). The varying depth of the surface defining the central head receiving recess acts to form different diameter vent holes, because the valleys taper inwardly as they go deeper toward the first contact surface portion. Thus, larger diametered vent holes are provided in the more central, deepest portion of the head receiving recess (where air circulation would be even more difficult to provide, once the head is nested within the recess) and smaller diametered vent holes are provided on the upwardly sloping surface of the head receiving recess where air circulation would be difficult, but less problematic than the deepest portion of the recess.

BRIEF DESCRIPTION OF THE DRAWINGS

The advantageous aspects of the invention will be more fully appreciated from the following detailed description, particularly when considered in conjunction with the attached drawings, wherein.

DETAILED DESCRIPTION OF THE INVENTION

The pillow in accordance with the invention is described hereinafter in terms of various specific and preferred embodiments, as illustrated in the appended figures. These embodiments should be considered as illustrative of the invention, and not as limiting the same.

Figure 1:
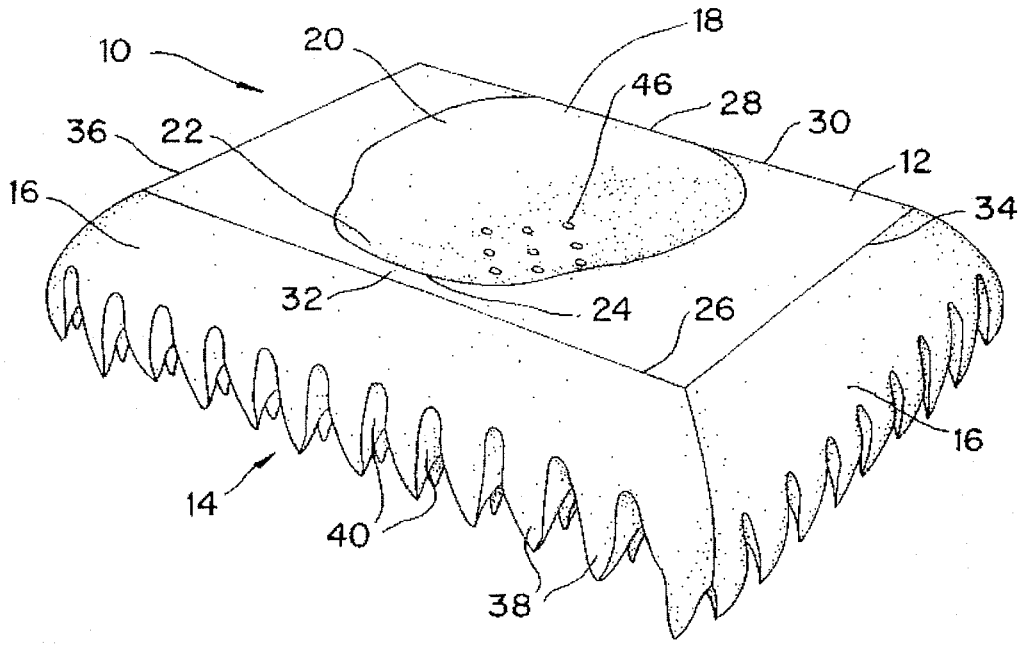
FIG. 1 illustrates a perspective view of a first exemplary embodiment of the pillow in accordance with the invention.

FIGS. 1–9 illustrate various views of the pillow in accordance with a first embodiment of the invention. FIG. 1 is a perspective view of the pillow 10 which shows a first main surface or contact surface portion 12, and a second main surface or contact surface portion 14 located opposite the first contact surface portion 12. Preferably, the pillow 10 is made from a commercially available polyurethane foam material, such as those available from Carpenter Co. of Richmond, Va., USA (e.g., Omalux® or a less dense polyurethane foam). While a polyurethane foam material having a density and IFD values selected so as to provide a desired level of support to suit the taste or requirements of the user is preferred, materials other than polyurethane foam may be used, if desired.

Figure 2:
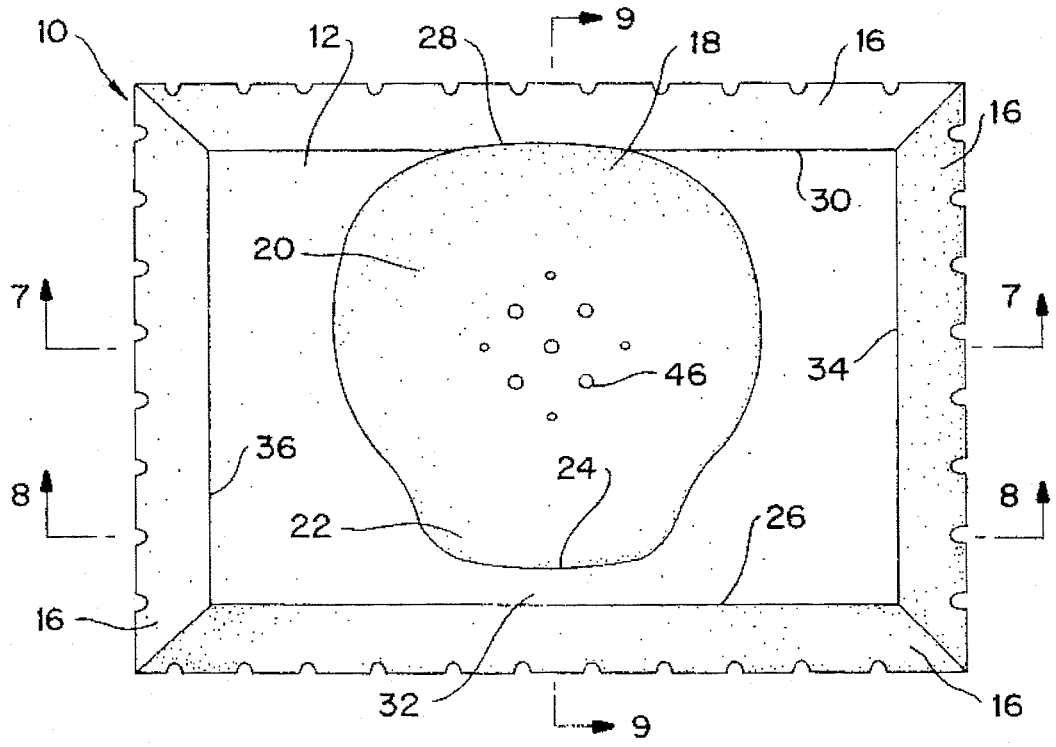
FIG. 2 shows the pillow of FIG. 1 looking down at a first main contact surface portion of the pillow including the head receiving recess.

Peripheral side surfaces 16 extend between the first contact surface portion 12 and the second contact surface portion 14. (A single side surface is also contemplated for a pillow having a circular or circular-like periphery.) As also shown in FIG. 2, the peripheral side surfaces 16 of the pillow may bulge outwardly in a rounded fashion, such that the peripheral side surfaces 16 are visible from the overhead view of the pillow 10 which shows the first contact surface portion 12. The first contact surface portion 12 has a head and neck receiving recess 18 extending inwardly into the pillow 10, in the direction toward the second contact surface portion 14. As illustrated in FIG. 1, the first contact surface portion 12 includes a generally planar foam surface that surrounds the centralized head and neck receiving recess 18.

The head and neck receiving recess 18 is provided for receiving the head and neck of the pillow user during use. As illustrated in FIGS. 1 and 2, preferably the head and neck receiving recess 18 is the only recess formed in the first contact surface portion 12. This recess 18 is centrally located in the first contact surface portion 12, and it preferably includes a more central depression area 20 (also called a "head support portion 20" in this specification) and a less central depression area 22 (also called a "neck support portion 22" in this specification). The less central depression area 22 is located such that bottom boundary edge 24 (that closest to the shoulders in use) of the less central depression area 22 is adjacent one longitudinal edge 26 of the first contact surface portion 12 of the pillow. A portion of the upper boundary edge 28 (that furthest from the shoulders in use) of the head receiving recess 18 is located adjacent a longitudinal edge 30 of the first contact surface portion 12 which is opposite to longitudinal edge 26. Preferably, the less central depression area 22 is narrower in longitudinal length than the more central depression area 20 of the head receiving recess 18. Furthermore, it is preferred that, at its deepest depth, the centralized head receiving recess 18 has a depth of about 3 to 9 cm (preferably about 6 cm), which represents about 25 to 60% of the overall pillow thickness (i.e., the length of a vertical line extending from the tip of a finger to the planar surface of the pillow surrounding the head receiving recess 18). Preferably, the depth of the recess 18 corresponds to about 40% of the overall pillow thickness.

As illustrated in FIG. 2, the neck support portion 22 of the head and neck receiving recess 18 does not extend to the longitudinal edge 26 of the first contact surface portion 12 of the pillow. A small ledge 32 of the first contact surface portion 12 remains between the longitudinal edge 26 and the neck support portion 22 of recess 18. In this manner, the neck support portion 22 of recess 18 is not visible in a side elevational view of side surface 16 of the pillow, as also apparent from FIG. 3. In this embodiment of the pillow, the elevational side view of the side opposite the side which includes longitudinal edge 26 is a mirror image of the side including longitudinal edge 26. In other words, the elevational side view of the side which includes longitudinal side edge 30 is a mirror image of the side including side edge 26.

Figure 4:
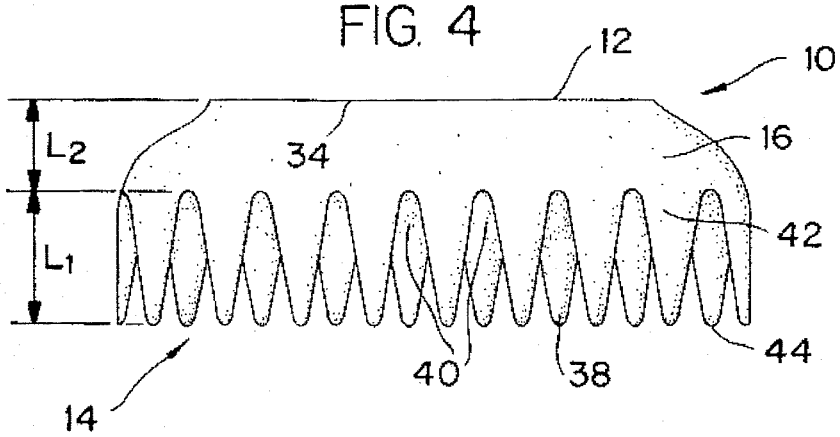
FIG. 4 is an end view of the pillow of FIG. 1.

FIG. 4 is a view of the pillow 10 in accordance with the invention as viewed from an end thereof. FIG. 4 shows an end elevational view of the end that includes an end edge 34. The end elevational view of the opposite end would be a mirror image of that which is shown in FIG. 4.

The second contact surface portion 14 includes a plurality of protrusions or projections 38 separated from one another by valleys or recesses 40, to thereby provide a convoluted second contact surface portion 14 which extends from an intermediate portion of the pillow with respect to its thickness. In the embodiment illustrated in FIGS. 1–9, the protrusion 38 and valley 40 construction extends over an entire surface area of the second contact surface portion 14.

Figure 5:
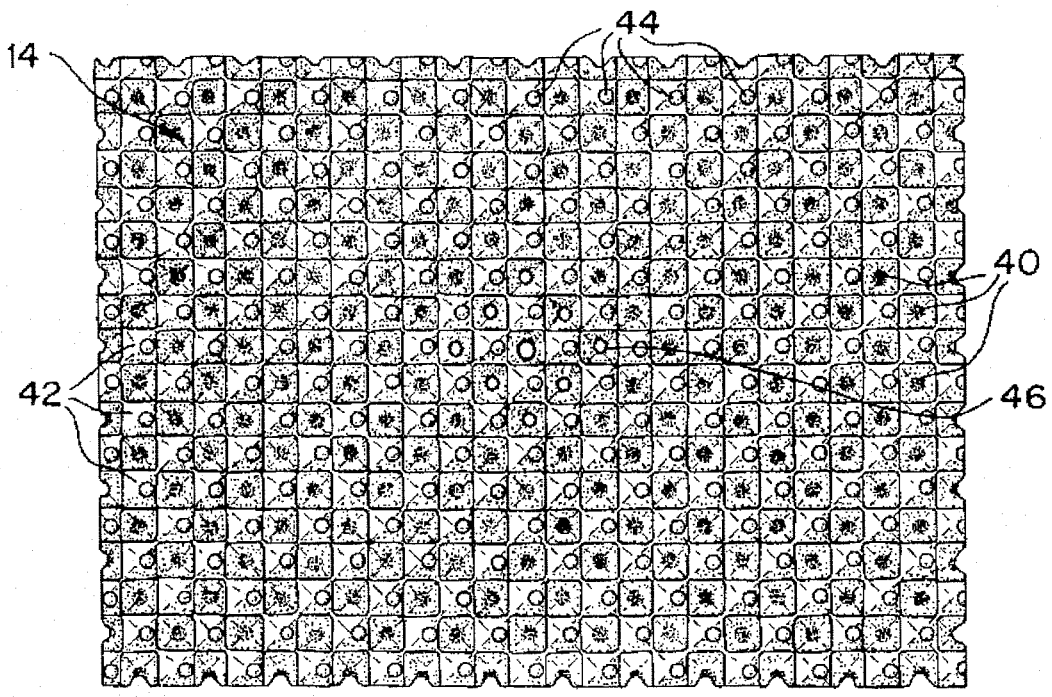
FIG. 5 shows the pillow of FIG. 1 looking down at a second main contact surface portion of the pillow including the extending fingers.
Figure 7:
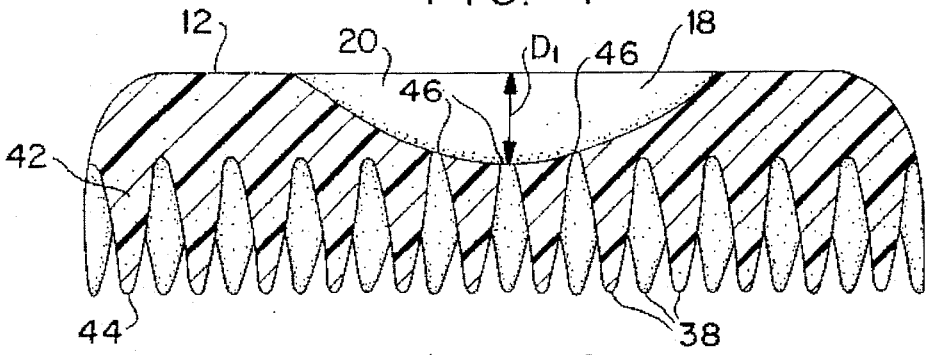
FIG. 7 is a cross-sectional view taken along lines 7—7 in FIG. 2.
Figure 8:
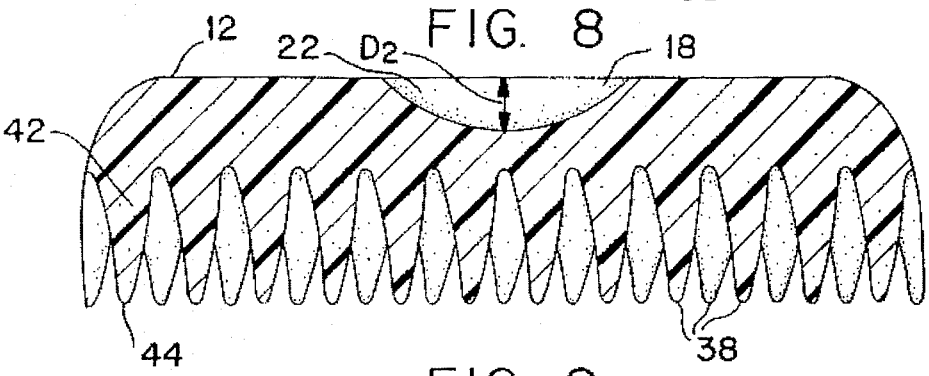
FIG. 8 is a cross-sectional view taken along lines 8—8 in FIG. 2.
Figure 9:
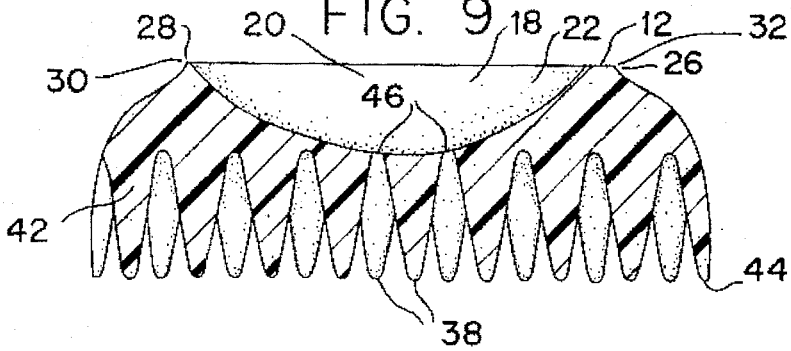
FIG. 9 is a cross-sectional view taken along lines 9—9 in FIG. 2.

With particular reference to FIGS. 7–9, the protrusions 38 are preferably finger shaped or conical shaped. The finger shaped protrusions 38 extend such that a base area 42 of the finger shaped protrusion 38 is located closer to the first contact surface portion 12 than the tips 44 of the finger shaped protrusions 38 which extend out away from the first contact surface portion 12. The protrusions 38 are essentially of a common length such that the finger tips 44 lie essentially in a common plane, which plane is essentially parallel to the essentially planar surface area of the first contact surface portion 12 (ignoring the recess 18). While the protrusions 38 may be straight such that the tips 44 are located directly over the center of their respective base areas 42, this is not a requirement. The protrusions 38 may be somewhat curved (e.g., as a result of production of the convoluted surface or by design), such that the tips 44 are not directly over the center of their base areas 42, as illustrated in FIG. 5.

The base area 42 of each protrusion 38 meets with the base area 42 of at least one adjacent protrusion 38. The valley areas or recesses 40 extend below a level of the base areas 42 and are positioned between adjacent protrusions 38. The present invention also contemplates lessening the height of certain protrusions so as to provide a lower head and/or neck reception area in the second contact surface portion. However, the preferred narrow finger shaped protrusions 38 of the preferred embodiment of the invention inherently provide a good nesting arrangement for both the head and the neck so as to make height differences unnecessary.

Preferably, the protrusions or extensions 38 have a length $L_1$ (FIG. 4) extending from their base 42 to their tip 44 which represents about 20 to 50% of a total maximum thickness ($L_1$+$L_2$) of the pillow between the first contact surface portion 12 and the second contact surface portion 14. The top of the protrusions 38 are preferably somewhat curved or rounded so as to present a tip. Other embodiments are also envisioned such as a planar upper surface at the top of the protrusions, although the tipped embodiment is more preferred. Also, it is preferred that the base 42 of the protrusions 38 have a maximum peripheral, cross-sectional area of less than 12 $cm^2$. The diameter of a horizontal cross-section at base 42 preferably is of a length that is 25 to 100% of the length $L_1$ of the finger-shaped protrusion.

FIGS. 7–9 are sectional views taken along the corresponding section lines shown in FIG. 2. FIG. 7 is a longitudinal section taken essentially through the more central depression area 20 of the head and neck receiving recess 18 at the central area of the pillow 10. FIG. 8 is a longitudinal sectional view through the less centrally located neck support portion 22 of the head and neck receiving recess 18. As is evident from a comparison of FIGS. 7 and 8, the head receiving recess 18 is deeper in the more central head depression area 20 thereof than it is at the less central depression area (i.e., neck support portion) 22. In other words, $D_1$ in FIG. 7 (having a depth of 3 to 9 cm) is greater than depth $D_2$ in FIG. 8 (having a depth of 1 to 5 cm), with the ratio of $D_1$ to $D_2$ preferably being about 1.5:1 to 4:1. In other words, head receiving recess 18 includes a more central depression area 20 (which coincides with the section taken along lines 7—7 in FIG. 2) and a less central depression area 22 (which coincides with the section taken along lines 8—8 in FIG. 2). The less central depression area 22 extends from a boundary portion of the more central depression area 20 and toward a side surface 16 of the pillow. Furthermore, the more central depression area 20 is deeper than the less central depression area 22. FIGS. 7 and 8 also illustrate that the longitudinal length of the less central depression area 22 is narrower than that of the more central depression area 20 of the head and neck receiving recess 18 (e.g., the longitudinal length of the neck support portion 22 being about 40 to 65%, and preferably about 55%, of the longitudinal length of the larger head support portion 20).

FIG. 9 is a cross sectional view laterally extending across a central portion of the pillow. As noted above and further illustrated in FIG. 9, boundary edge 28 of the head and neck receiving recess 18 is located adjacent a longitudinal edge 30 of the first contact surface portion 12. FIG. 9 further illustrates that the neck support portion 22 of the head receiving recess 18 does not extend to the longitudinal edge 26 of the first contact surface portion 12 of the pillow. Rather, a small ledge 32 of the first contact surface portion 12 remains between the longitudinal edge 26 and the neck support portion 22. Thus, the neck support portion 22 would not be visible in a side elevational view of side surface 16 of the pillow (see also FIG. 3).

The depth or lateral length of the preferred rectangular embodiment shown in the figures (i.e., the length from edge 26 to edge 30) is preferably about 25 to 40 cm in length, or more preferably, about 30 cm. The lateral length of the head recess is preferably about 85 to 95% of the total lateral length of the pillow.

Figure 6:
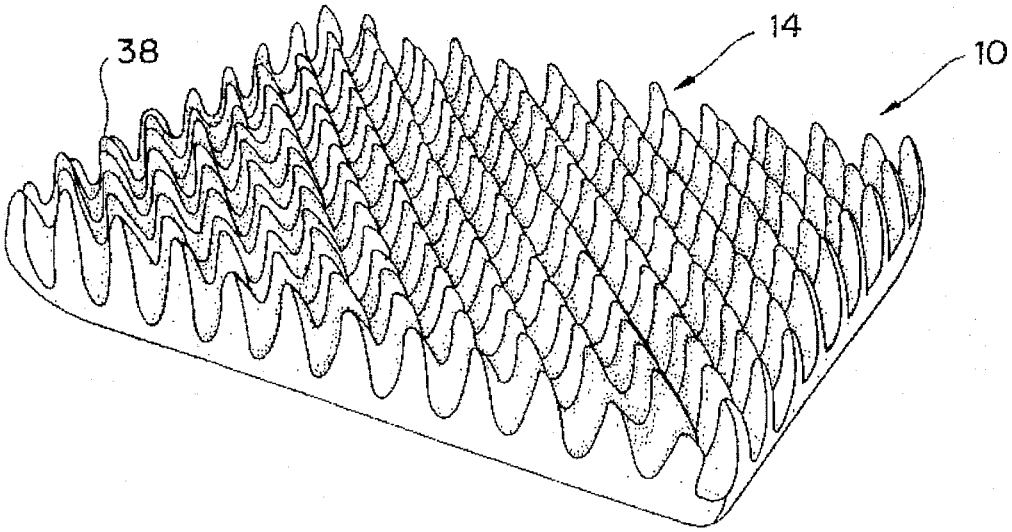
FIG. 6 illustrates a perspective view of the pillow of FIG. 1 showing the second main contact surface portion of the pillow.

FIGS. 5–9 also illustrate a preferred embodiment of the invention wherein the protrusions 38 are arranged in a plurality of rows. The protrusions 38 are preferably arranged in staggered longitudinal rows such that the protrusions 38 in one longitudinal row are located between two adjacent protrusions 38 in a next, adjacent longitudinal row. This is illustrated in the planar view in FIG. 5 and the cross sectional views of FIGS. 7 and 8. In this manner, the protrusions 38 in the transverse rows, as illustrated in FIG. 9, also will line up in a similar staggered arrangement. Accordingly, this staggered longitudinal and transverse row arrangement will provide unstaggered, diagonal rows of protrusions 38, as illustrated in FIGS. 5 and 6.

FIGS. 1 and 2 illustrate an additional feature of the preferred embodiment of the pillow in accordance with the invention. As illustrated therein, a plurality of vent holes 46 extend through the pillow 10, and open out at the first contact surface portion 12 and second contact surface portion 14. It is preferred that the vent holes 46 are provided only in the deepest, more central depression area 20 of the head and neck receiving recess 18 of the pillow. It is particularly preferred that the vent holes 46 are provided in a linear arrangement with the valleys 40 in the second contact surface portion 14. In other words, the valleys 40 which are located in the area of the head receiving recess 18 extend upward in certain areas to the first contact surface portion 12 so as to produce the vent holes 46 therein. These vent holes 46 are also shown in the cross sectional views of FIGS. 7 and 9. As shown in these figures, the head support portion 20 of recess 18 extends to the internal-most end of the valleys 40 so as to automatically form those valleys into vent holes 46.

The valleys 40 can be formed subsequent to, at the same time as, or after the formation of head support portion 20. For example, the head receiving recess 18 can be formed through a known technique, such as by using a compression die with a horizontal blade, a hot wire cutter, a mold, etc. The protrusions 38 can also be formed in conventional fashion (e.g., with intermeshing roller dies and cutting blade). The invention involves, however, a unique formation method in that the depth of the valleys 40 and the depth of the head receiving recess 18 are coordinated such that the vent holes 46 are automatically formed upon formation of the head receiving recess 18 and the valleys 40.

A somewhat schematic overhead view of the second contact surface portion 14 is shown in FIG. 5. The tips 44 of the protrusions 38 are represented by the small circles distributed essentially over the entire area of second contact surface portion 14. The base area 42 of the protrusions 38 lies below the tips 44 and is represented by the block area surrounding the circle of the tips 44. The valleys 40 are provided in the areas between adjacent protrusions 38 and are represented by the blocks free of circles. Thus, each of the finger-like projections 38 is represented by a tip 44 with the body of the finger-like projection 38 tapering outwardly or expanding in circumference from the tip 44 down to the base 42. The vent holes 46 are located in the central area of the pillow and within the head receiving recess 18, as noted above. The vent holes 46 are shaded black in FIG. 5 to enable easy distinction from the tips 44 of the protrusions 38. The finger like projections or protrusions 38 can also have a slight, commonly directed curvature over their length so as to provide a bow-type suspension.

Figure 10:
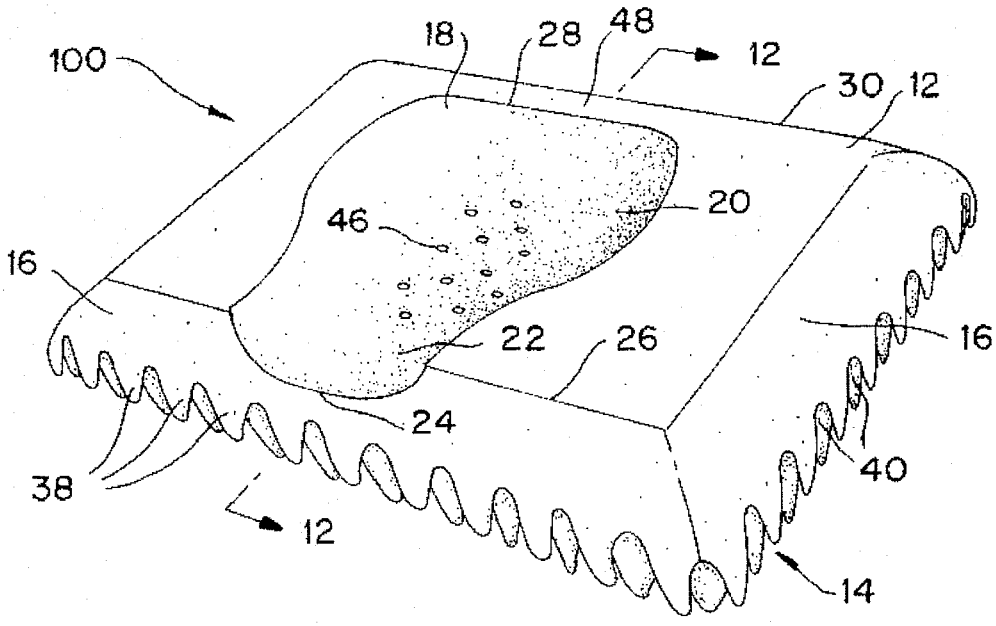
FIG. 10 illustrates a perspective view of a second exemplary embodiment of the pillow in accordance with the invention.
Figure 11:
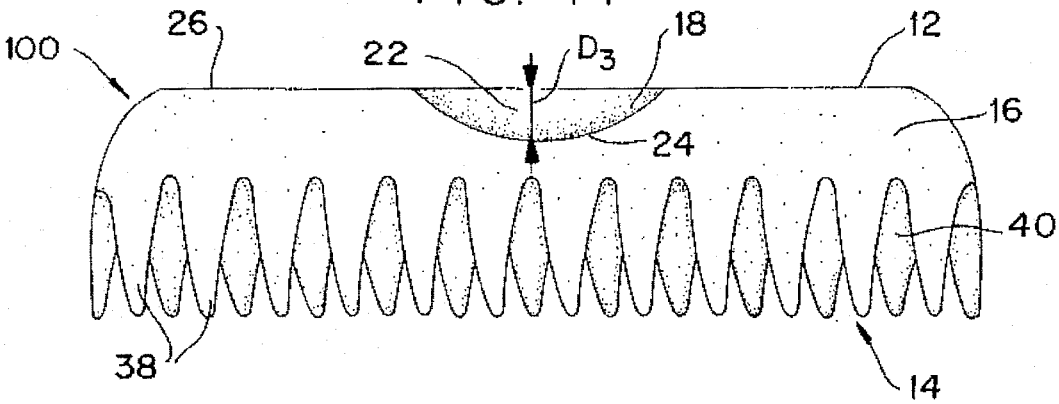
FIG. 11 is a longitudinal side view of the pillow of FIG. 10.
Figure 12:
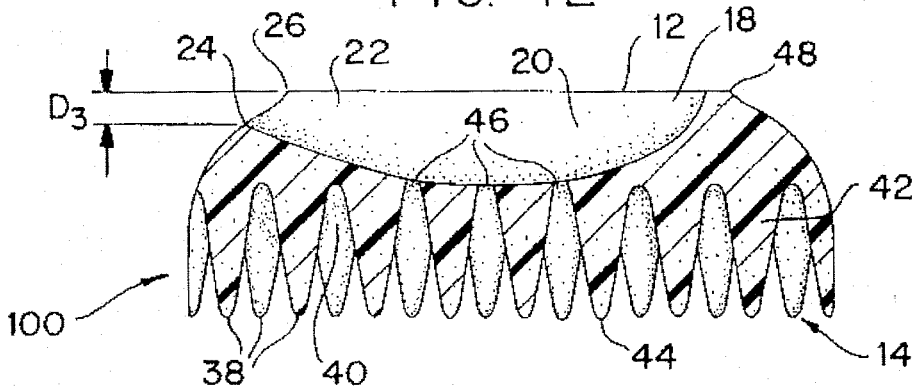
FIG. 12 is a cross-sectional view taken along lines 12—12 in FIG. 10.

FIGS. 10–12 illustrate a second embodiment of the pillow 100 in accordance with the invention. In these Figures, reference numbers which correspond to portions of the pillow 10 illustrated in FIGS. 1–9 are used to represent similar portions of the pillow 100 of FIGS. 10–12. Thus, the description of this embodiment will be limited to the manner in which the pillow 100 differs from the pillow 10 of FIGS. 1–9.

The pillow 100 of this second embodiment is similar to the pillow 10 of the first embodiment except the positioning of the head and neck receiving recess 18 is different (i.e., shifted laterally). In the embodiment shown in FIGS. 10–12, the head and neck receiving recess 18 extends to the longitudinal edge 26 of the first contact surface portion 12 such that the neck support portion 22 of the head and neck receiving recess 18 is visible along an elevational view of the peripheral side surface 16 of the pillow. FIG. 11 shows an elevational view of side surface 16 of the pillow. As evident from this Figure, the edge 24 of the neck support portion 22 is visible from this direct longitudinal side view. Also, $D_3$ represents the depth which the edge 24 extends into the pillow at its point of opening out at the side of the pillow. Preferably, this depth $D_3$ is in the range of 1 to 4 cm.

Figure 3:
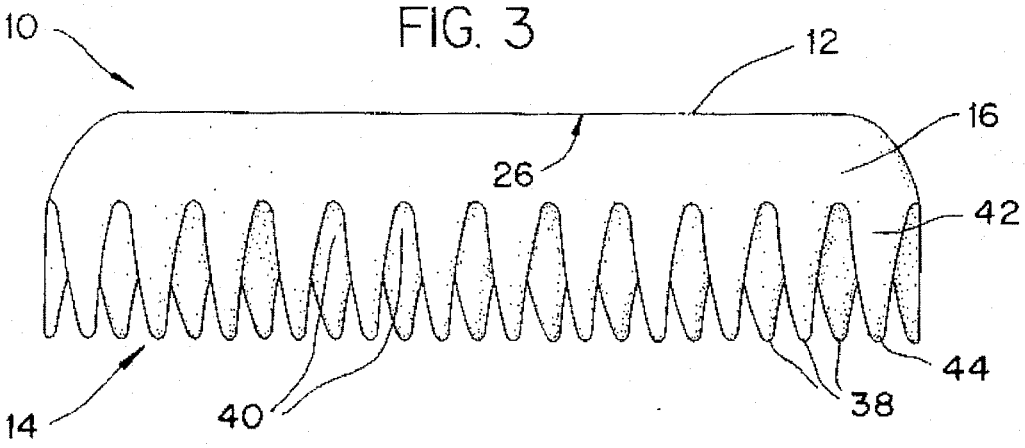
FIG. 3 is a longitudinal side view of the pillow of FIG. 1.

The opposite longitudinal side view of the pillow 100, along longitudinal edge 30, would look the same or substantially similar to FIG. 3 which shows the pillow 10 of the first embodiment of the invention. Similarly, the end views of the pillow 100 of this embodiment would look the same or substantially similar to FIG. 4 which shows the pillow 10 of the first embodiment.

FIG. 12 is a cross-sectional view along lines 12—12 of FIG. 10. This cross section also shows that the edge 24 of the neck support portion 22 extends to and beyond the longitudinal edge 26 of the first contact surface portion 12. This edge 24 extends the depth $D_3$ down the side 16, as noted above. (The portion extending beyond the top edge 26 being that portion of the neck support portion 22 formed in the outwardly curved portion of side surface 16 of the pillow.)

The top edge 28 of the head receiving recess 18 is moved forward (closer to a user's shoulders) such that a ledge 48 of material is located between the top edge 28 of the recess 18 and the longitudinal edge 30 of the first contact surface portion 12.

These figures also show that the illustrated second embodiment has a similar second contact surface portion 14 construction, including the arrangement of the protrusions 38, valleys 40 and vent holes 46, as the embodiment illustrated in FIGS. 1–9.

The use and various multi-positional features of the pillow in accordance with the invention are illustrated in FIGS. 13–16. The first contact surface portion 12 of the pillow is used to provide relatively firm support for the user. This first contact surface portion 12 is non-convoluted and smooth so as to provide more foam contact, and thus firm support. The second contact surface portion 14 provides a relatively soft support surface in that the finger-like projections 38 place less foam in contact with the user's head and/or face and more freely expand outward as they are compressed. At least some of the tips of the elongated finger-like extensions also readily bow or curve over so as to reduce concentrated point contact between the face of the user and the tips.

Figure 13:
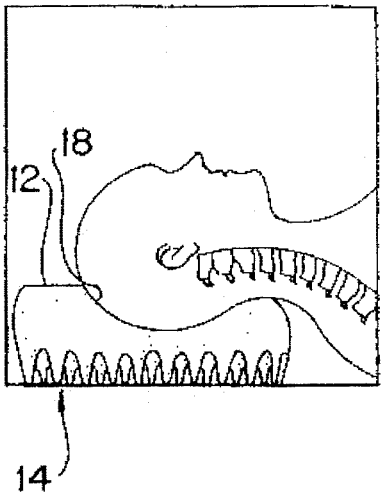
FIGS. 13–16 show the pillow in accordance with the invention in its multiple use positions.
Figure 14:
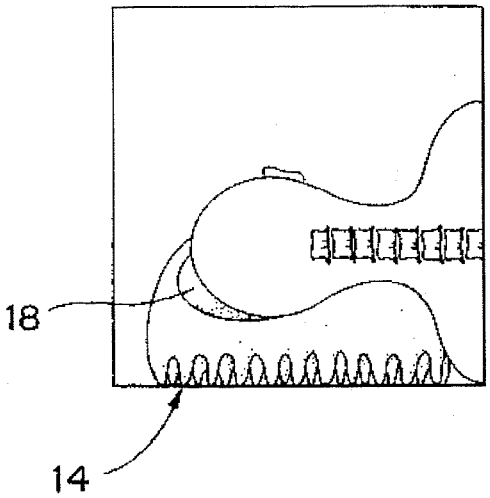

In the pillow in accordance with the invention, the first and second contact surface portions are each dimensioned and arranged such that either surface can provide head support for the user, while the opposite surface contacts an underlying support, such as a mattress. FIG. 13 illustrates the pillow in use with the first contact surface portion 12 being used to provide firm support. The second contact surface portion 14 lies against the mattress. The head of the person is placed in the head receiving recess 18, and the contoured neck support portion 22 of the head receiving recess 18 is provided to cradle and support the neck. As an alternative position, as shown in FIG. 14, the user may lay on his side with his head supported in the head receiving recess 18. In this position, the spine remains relatively straight as the neck is received in the neck support portion 22, thereby reducing the chance of neck pain.

Figure 15:
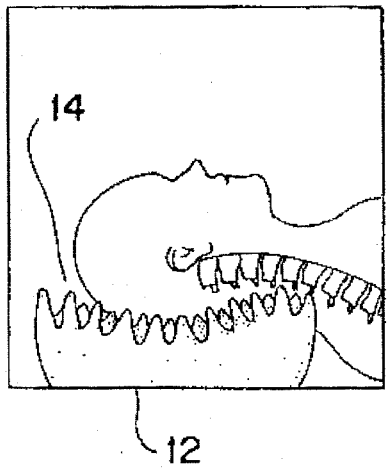
Figure 16:
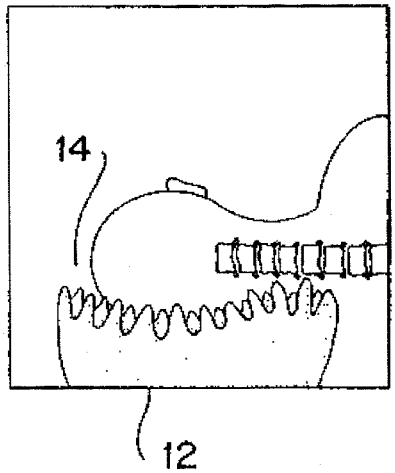

Two alternative positions for using the pillow are shown in FIGS. 15 and 16. In these figures, the pillow is flipped over so as to provide softer support with the convoluted second contact surface portion 14 adjacent the head, and the first contact surface portion 12 is against the mattress. Because of the relative softness of the convoluted second contact surface portion 14, the head is cradled in the underside of the head receiving recess 18, and the neck is cradled in the underside of the neck support portion 22 of the head receiving recess 18. In this configuration, the head and neck are supported, but the support is softer.

The scooped out head receiving recess 18 of the pillow may be formed by methods known to those skilled in the art. For example, it may be formed by forcing a central portion of the first contact surface portion 12 of the pillow through a die by way of a compression member and cutting out the material squeezed through the die to thereby form the recess 18. Likewise, the convoluted second contact surface portion 14, including the protrusions 38 and valleys 40, may be formed by methods known to those skilled in the art, such as by running a polyurethane foam blank through a pair of rollers with intermeshing die projections, and cutting the foam while in a compressed state. As the surface configurations of the first and second contact surface portions 12 and 14 are produced, the vent holes 46 are automatically provided in the more central depression area 20 of the head receiving recess 18 due to the coordination of the valley 40 depth and the recess 18 depth. Preferably, each valley 40 depth over the entire surface of the pillow is of a common length (as are the adjacent protrusions). Alternatively, the vent holes 46 can be formed by punching out, cutting or carving out specific valleys 40 to open the valleys out to the opposite contact side portion and provide the vent holes 46. In this situation, the valley depth would not reach the recess 18. The present invention also contemplates the formation of additional vent holes in the neck support portion 22. As the neck support portion 22 is less deep than the head support portion 20 of recess 18, a hybrid arrangement of automatically forming vent holes 46 in the more central depression area 20 and adding an additional step to remove foam material between the tip of the valley and the adjacent surface forming the neck support portion 22. Alternatively, the depth of the valleys, head support portion 20 and neck support portion 22 can be coordinated so that relatively large diameter vent holes are automatically formed in head support portion 20 of recess 18 and smaller sized vent holes are formed in neck support portion 22 while maintaining portion 20 of recess 18 deeper than portion 22.

While the invention has been described in terms of various preferred embodiments and methods for performing the procedure, those skilled in the art will recognize that various changes and modifications may be made without departing from the spirit and scope of the invention, as defined in the appended claims.

What is claimed is:

1. A pillow, comprising:

a first contact surface portion;

a second contact surface portion;

a peripheral side edge extending between said first contact surface portion and said second contact surface portion;

said first contact surface portion having a head receipt recess extending inwardly into said pillow;

said second contact surface portion including a plurality of protrusions separated by valleys;

wherein said first contact surface portion and said second contact surface portion are both dimensioned and arranged such that either contact surface portion can provide user head support while an opposite contact surface portion contacts an underlying support, and wherein said head receipt recess is essentially centrally positioned with respect to said first contact surface portion and includes a more central depression area for receiving a head of a user and a less central neck support depression area extending from a peripheral boundary of said more central depression area and opening into said more central depression area, and wherein said first contact surface includes a planar border region which defines the peripheral boundary of said more central depression area, encompasses said more central depression area, and is free of interruptions except for said neck support depression area, and said neck support depression area having an uppermost surface which is at a level below that of a portion of said bordering region closest to said neck support depression area.

2. A pillow as recited in claim 1, wherein a plurality of vent holes extend through said pillow so as to open out on both said first contact surface portion and said second contact surface portion and said vent holes opening out into said more central depression area.

3. A pillow as recited in claim 1, wherein a plurality of vent holes extend through said pillow so as to open out on both said first contact surface portion and said second contact surface portion.

4. A pillow as recited in claim 1, wherein said plurality of protrusions and valleys are distributed over all of said second contact surface portion, and said entire border region extends out at a common level into contact with the periphery of said pillow.

5. A pillow as recited in claim 1, wherein said protrusions include conical shaped extensions each having a base portion contacting an adjacent extension, and said valleys extending below a level of said base portions and positioned between adjacent extensions.

6. A pillow, comprising:

a first contact surface portion which has a centralized recess formed therein which is adapted to receive a head of a user, said first contact surface being a non-convoluted, planar surface and representing an exterior surface of said pillow, said first contact surface further comprising a less centralized recess defining a neck support depression which opens out at one end into said centralized recess and extends away from said centralized recess and toward a peripheral edge of said pillow, add said first contact surface including a first bordering surface portion extending in circular fashion about said centralized recess and a second bordering surface portion extending along said neck depression, and said first and second bordering surface portions being at a common level, and said neck depression having a width at a juncture of said central and neck depressions which is less than a width of said centralized recess;

a second contact surface portion opposed to said first contact surface portion, said second contact surface portion including a convoluted surface with a plurality of protrusions extending out away from an intermediate portion of said pillow.

7. A pillow as recited in claim 6, wherein said protrusions are tapered extensions with a base area greater than a top area, wherein valleys are formed between said protrusions, said pillow further including a plurality of through holes opening into said centralized recess and into at least some of said valleys provided on said second contact surface portion.

8. A pillow as recited in claim 7, wherein said first contact surface portion includes a planar surface surrounding said centralized recess, and said protrusions are all of essentially a common height so as to define a planar initial contact surface, wherein said protrusions are distributed over an entire area of said second contact surface portion.

9. A pillow as recited in claim 6, wherein said less central depression area extends off from a boundary portion of said more central depression area and toward a side edge of said pillow.

10. A pillow as recited in claim 9, wherein said more central depression area is deeper than said less central depression area and said less central depression area opens out along said side edge of the pillow.

11. A pillow, comprising:

a first main face, wherein the first main face includes a head receiving recess defined therein;

a second main face opposite the first main face, wherein the second main face includes a plurality of extending fingers, wherein the fingers extend such that a base of said finger is located closer to an intermediate portion of said pillow than a tip of said fingers, wherein the finger tips essentially lie in a common plane;

wherein a plurality of recesses are defined in the second main face in an area between a finger and surrounding, adjacent fingers;

wherein, in a portion of the second main face opposite the head receiving recess of the first main face, the recesses between adjacent fingers extend through the pillow so as to define a plurality of holes through the pillow in the head receiving recess.

12. A pillow as set forth in claim 11, wherein the fingers of the second main face are arranged in rows.

13. A pillow as set forth in claim 12, wherein the fingers are arranged in staggered rows along a longitudinal direction of the pillow, such that the fingers in one longitudinal row are located between two adjacent fingers in a next, adjacent longitudinal row.

14. A pillow as set forth in claim 11, wherein the head receiving recess includes a main head depression area and a different height level neck supporting depression area extending out away from an edge of the main head depression area.

15. A pillow as set forth in claim 14, wherein the neck supporting depression area extends in a lateral direction and is narrower in longitudinal length than the main head depression area of the head receiving recess.

16. A pillow as set forth in claim 14, wherein the neck supporting depression area of the head receiving recess extends to a longitudinal edge of the first main face such that the neck supporting depression area of the head receiving recess is visible along a side face of the pillow extending between the first main face and the second main face.

17. A pillow as set forth in claim 14, wherein the neck supporting depression area terminates a distance from the side edge of the pillow such that the neck supporting depression area does not open out into a side edge of the pillow extending between the first main face and the second main face.

18. A pillow as set forth in claim 11, wherein the pillow is a unitary body made entirely from a single type of polyurethane foam material.

19. A pillow, comprising:

a first main face including an essentially planar main surface having a head receiving recess and a neck receiving recess defined therein with said neck receiving recess opening into said head receiving recess and extending to a peripheral edge of said pillow, said first main surface representing an exterior surface of said pillow, and except for said head receiving and neck receiving recesses being non-convoluted and lying a common plane from said recesses out to the entire periphery of said pillow, and said head receiving recess being generally circular in configuration;

a second main face opposite the first main face, the second main face including a plurality of finger extensions each having a base portion and a free end defining a tip of said finger extensions, wherein a plurality of said finger extensions are of a common length such that the finger tips of said plurality of extensions essentially lie on a plane which is essentially parallel to the essentially planar main surface of the first main face; and a plurality of recesses defined in the area between a finger and the surrounding, adjacent fingers of the second main face, said recesses extending toward said first main face.

20. A pillow as set forth in claim 19, wherein, in a portion of the second main face opposite the head receiving recess of the first main face, recesses between adjacent fingers extend through the pillow to the first main face so as to define a plurality of holes through the pillow in the head receiving recess.

21. A pillow as set forth in claim 20, wherein the fingers of the second main face are arranged in rows and said holes are formed solely in said head receiving recess.

22. A pillow as set forth in claim 21, wherein the fingers are arranged in staggered rows along a longitudinal direction of the pillow such that the fingers in one longitudinal row are located between two adjacent fingers in a next, adjacent longitudinal row.

23. A pillow as set forth in claim 19, wherein the head receiving recess is located adjacent one longitudinal edge of the first main face and said neck receiving recess extends to a location adjacent an opposite longitudinal edge of the first main face.

24. A pillow as set forth in claim 23, wherein the neck support portion is narrower than a central portion of the head receiving recess in the longitudinal direction.

25. A pillow as set forth in claim 23, wherein the neck support portion of the head receiving recess extends to the longitudinal edge of the first main face such that the neck support portion of the head receiving recess is visible in a side elevational view of a side face of the pillow extending between the first main face and the second main face.

26. A pillow as set forth in claim 23, wherein the neck support portion of the head receiving recess does not extend to the longitudinal edge of the first main face such that the neck support portion of the head receiving recess is not visible along a side elevational view of a side face of the pillow extending between the first main face and the second main face.

27. A pillow as set forth in claim 19, wherein the pillow is a unitary body made entirely from a polyurethane foam material.

28. A method of forming a pillow, comprising:

modifying a body of foam material so as to provide a plurality of elongated protrusions extending out away from an intermediate portion of the body with said protrusions extending in a common direction, and so as to provide a plurality of valleys extending into the intermediate portion of the body; and modifying the body by forming a head receiving recess which extends into the intermediate portion of the body from a side of the body that is opposite a side of the body in which the protrusions are located, wherein the head receiving recess is formed to a depth such that an innermost portion of the valleys open into a deeper region of said head receiving recess so as to define a plurality of vent holes through the body.

29. A method as recited in claim 28 wherein the head receiving recess is formed prior to said protrusions.

30. A pillow, comprising:

a first main face including an essentially planar main surface having a head receiving recess defined therein;

a second main face opposite the first main face, the second main face including a plurality of finger extensions each having a base portion and a free end defining a tip of said finger extensions, wherein a plurality of said finger extensions are of a common length such that the finger tips of said plurality of extensions essentially lie on a plane which is essentially parallel to the essentially planar main surface of the first main face; and a plurality of recesses defined in the area between a finger and the surrounding, adjacent fingers of the second main face, said recesses extending toward said first main face, and wherein, in a portion of the second main face opposite the head receiving recess of the first main face, recesses between adjacent fingers extend through the pillow to the first main face so as to define a plurality of holes through the pillow in the head receiving recess.

31. A pillow, comprising:

a first main face including an essentially planar main surface having a head receiving recess defined therein;

a second main face opposite the first main face, the second main face including a plurality of finger extensions each having a base portion and a free end defining a tip of said finger extensions, wherein a plurality of said finger extensions are of a common length such that the finger tips of said plurality of extensions essentially lie on a plane which is essentially parallel to the essentially planar main surface of the first main face; and a plurality of recesses defined in the area between a finger and the surrounding, adjacent fingers of the second main face, said recesses extending toward said first main face, and wherein the head receiving recess includes a neck support portion located adjacent one longitudinal edge of the first main face and a top portion located adjacent an opposite longitudinal edge of the first main face, and wherein the neck support portion of the head receiving recess does not extend to the longitudinal edge of the first main face such that the neck support portion of the head receiving recess is not visible along a side elevational view of a side face of the pillow extending between the first main face and the second main face.

32. A pillow, comprising:

a first contact surface portion;

a second contact surface portion;

a peripheral side edge extending between said first contact surface portion and said second contact surface portion;

said first contact surface portion having a head receipt recess extending inwardly into said pillow;

said second contact surface portion including a plurality of protrusions separated by valleys;

wherein said first contact surface portion and said second contact surface portion both are dimensioned and arranged such that either contact surface portion can provide user head support while an opposite contact surface portion contacts an underlying support, and wherein a plurality of vent holes extend through said pillow so as to open out on both said first contact surface portion and said second contact surface portion, and wherein said head receipt recess includes a more central depression area and a less central depression area extending off from a boundary portion of said more central depression area and toward a side edge of said pillow.

33. A pillow, comprising:

a first contact surface portion which has a centralized recess formed therein which is adapted to receive a head of a user;

a second contact surface portion opposed to said first contact surface portion, said second contact surface portion including a convoluted surface with a plurality of protrusions extending out away from an intermediate portion of said pillow, and wherein said protrusions are tapered extensions with a base area greater than a top area, wherein valleys are formed between said protrusions, said pillow further including a plurality of through holes opening into said centralized recess and into at least some of said valleys provided on said second contact surface portion, and wherein said head receipt recess includes a more central depression area and a less central depression area extending off from a boundary portion of said more central depression area and toward a side edge of said pillow.

* * * * *